US006851601B1

(12) United States Patent
Montoya

(10) Patent No.: US 6,851,601 B1
(45) Date of Patent: Feb. 8, 2005

(54) DUAL PIZZA PIE CONTAINER SYSTEM

(76) Inventor: Juan F. Montoya, 5250 NW. 114th Ave., #102, Miami, FL (US) 33178

( * ) Notice: Subject to any disclaimer, the term of this patent is extended or adjusted under 35 U.S.C. 154(b) by 0 days.

(21) Appl. No.: 09/954,970

(22) Filed: Sep. 19, 2001

(51) Int. Cl.[7] ..... B65D 5/49
(52) U.S. Cl. ..... 229/120; 229/120.32; 229/906
(58) Field of Search ..... 229/120, 120.21, 229/120.32, 902, 906; 426/115, 119, 120

(56) References Cited

U.S. PATENT DOCUMENTS 2,758,774 A * 8/1956 Grunert et al. ..... 229/120
2,850,224 A * 9/1958 Meinhardt et al. ..... 229/120.21
3,291,367 A * 12/1966 Carter ..... 229/120
4,441,626 A * 4/1984 Hall ..... 229/120
4,836,383 A * 6/1989 Gordon et al. ..... 229/120.21
4,957,237 A * 9/1990 Madonna et al. ..... 229/120
5,002,221 A * 3/1991 Ragan ..... 229/120
5,209,392 A * 5/1993 Anatro ..... 229/906
5,351,880 A * 10/1994 Goudreau ..... 229/120.32
5,445,314 A * 8/1995 Newsome ..... 229/120.21
5,950,912 A * 9/1999 Economopoulos ..... 229/120.32
6,386,440 B1 * 5/2002 Tulkoff ..... 229/120.32

* cited by examiner

*Primary Examiner*—Gary E. Elkins
(74) *Attorney, Agent, or Firm*—M. K. Silverman

(57) ABSTRACT

A dual pizza pie container system is provided, which includes a solid rectangular enclosure and a pizza support platform within the enclosure. The pizza support platform includes four foldable equilateral flaps which, when folded to generally right angles relative to a central base, define an octahedron having four long edges defining a virtual square and four alternating diagonal edges at corners of the support platform when folded. One of the equilateral flaps is provided with an aperture therein which effects registration with the an aperture of the fourth sidewall of the top cover of the enclosure in which widths of the equilateral sidewalls of the platform define about one-half of the height of the sidewalls of the enclosure. Thereby, upper and lower interior solid horizontal compartments, one above and one below the platform, are defined when the support platform is positioned within the enclosure and the enclosure is closed.

6 Claims, 5 Drawing Sheets

DUAL PIZZA PIE CONTAINER SYSTEM

BACKGROUND OF THE INVENTION

1. Area of Invention:

The present invention relates to pizza boxes and pizza box systems that are particularly adapted for the containment and delivery of more than a single pizza pie.

2. Prior Art:

The prior art of pizza containers capable of holding two or more pizza pies is very limited and, to the knowledge of the within inventor, consists of U.S. Pat. No. 5,725,146 (1998) by .Luberto, entitled Box With Raised Structurally Enhanced Top Cover Having Vent Openings; and No. 5,950,912 (1999) entitled Dual Pizza Pie Box, by Economopoulos. The instant invention is also an improvement over my Columbian patent issued in March, 2001.

A problem in pizza boxes and containers of the present type has been that of providing adequate venting and stability for each of the levels of pizza containments therein. Said patent to Luberto offers one solution, however, one which results in a highly complex and therefore expensive pizza box container. Said patent to Economopoulos teaches the use of an essentially solid rectangular box for the transporting of two pizza pies in a vertically stacked formation in which the box is provided with corner shelf supports for the positioning of a second or third pizza pie. To achieve this result, a complex pattern of cutting and scoring of the pizza box blank is necessary. Also, there is no assurance that the corner shelf supports of the system of Economopoulos will successfully support the upper pies in the event of tilting or vibration of the pizza box. For these reasons, neither Luberto nor Economopoulos provides a practical solution to the long felt need in the art for a single pizza box container capable of accommodating and rendering practical the delivery of two or more pizza pies. The present invention thereby responds to this long felt need in the art.

SUMMARY OF THE INVENTION

There is herein provided a dual pizza pie container system comprising a solid rectangular enclosure and a pizza support platform proportioned for placement within said enclosure. More particularly, the enclosure comprises (i) a substantially square bottom base comprising at least three peripheral sidewalls foldably integral with said base, each width of each sidewall generally defining a height of said enclosure; and (ii) a top cover comprising a base and four sidewall, one thereof integral to both an edge of said base of said top cover and to an edge of said bottom base, said fourth side wall having at least one aperture therein. Said pizza support platform includes four foldable equilateral flaps which, when folded to generally right angles relative to a central base thereof, define an irregular octahedron having four long edges respectively defining a virtual square and four alternating diagonal edges at corners of the support platform when folded, said base of said platform proportioned for placement within said bottom base and said sidewalls of said enclosure when assembled. At least one of said equilateral flaps is provided with at least one aperture therein which, upon assembly of the system, effects registration with said at least one aperture of said fourth sidewall of said top cover, in which widths of said equilateral sidewalls of said platform define about one-half of the height of the sidewalls of said enclosure. Thereby, upper and lower interior solid horizontal compartments, one above and one below said platform, are defined when said support platform is positioned within said enclosure and said enclosure is fully closed. Said diagonal edges of said support platform facilitate manual engagement thereof, and said apertures within the system facilitate escape of steam from both upper and lower horizontal compartments of the resultant structure.

It is accordingly an object of the present invention to provide a dual pizza pie containment system using commonly available materials such as corrugated cardboard.

It is another object to provided a system of the above type to enable a reliable means of simultaneous transport of at least two pizza pies within a minimum volume, without deterioration of the pies during the transport thereof, and stability of the pies therein.

It is a further object of the invention to provide a system of the above type in which corrugated cardboard blanks thereof may be readily assembled, conveniently transported, and simply opened and used by the customer after delivery.

It is a yet further object to provide a dual pizza pie container of the above type which assures substantially hermetic closure thereof while also permitting a sufficient escape of steam to assure that the pies will not deteriorate during transport as a result of undue accumulation of steam pressure within the container itself.

The above and yet other objects and advantages of the present invention will become apparent from the hereinafter set forth Brief Description of the Drawings, Detailed Description of the Invention and claims appended herewith.

DETAILED DESCRIPTION OF THE INVENTION

Figure 1:
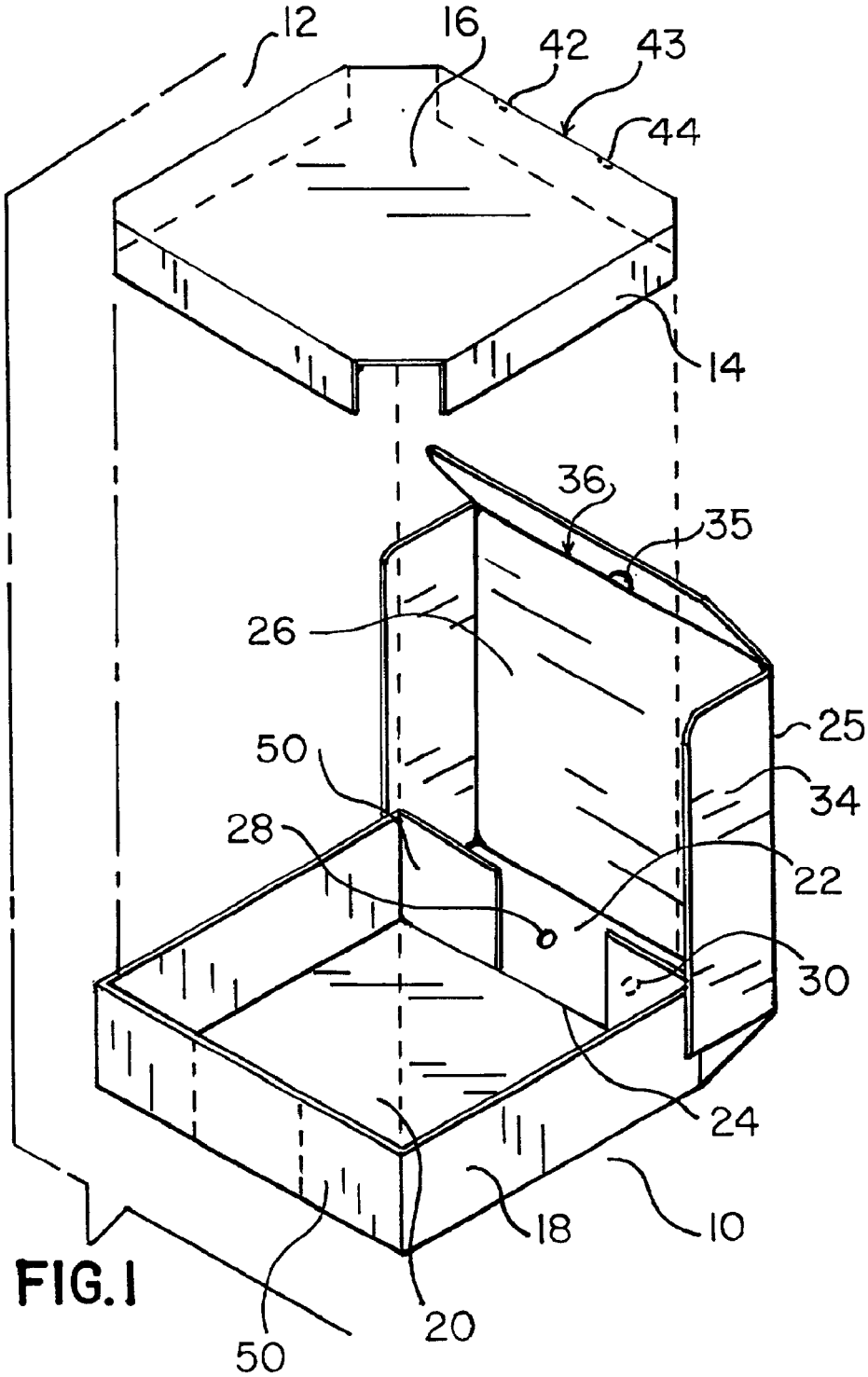
FIG. 1 is an exploded view showing the respective positioning of the pie support platform and the pie enclosure prior to positioning of second-level creating platform upon the base of the enclosure.

With reference to the exploded view of FIG. 1, the inventive dual pizza pie container system may be seen to include a foldable enclosure 10 and a pie support platform 12. When flaps 14 thereof are folded into a substantially normal position relative to a platform portion 16 thereof, said platform and flaps may be readily slip-fitted within sidewalls 18 which depend integrally from a substantially square bottom base 20 of enclosure 10. More particularly, enclosure 10 may be seen to comprise said substantially square bottom base 20, at least three of said peripheral sidewalls 18 which are foldably integral with said base 20.

Figure 4:
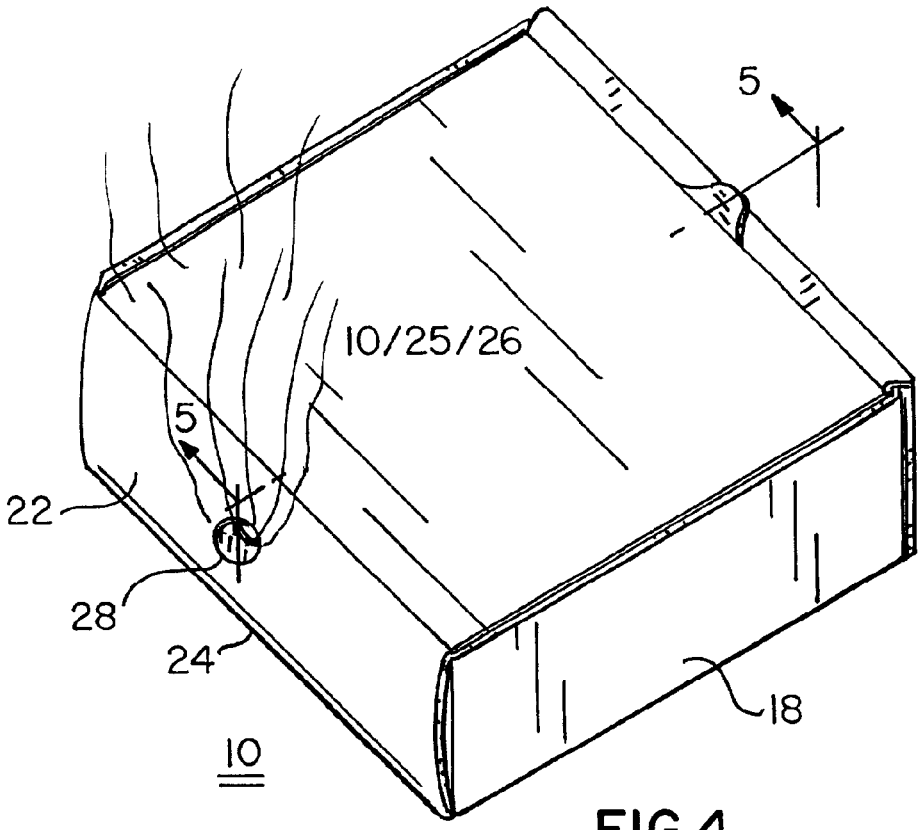
FIG. 4 is a rear diagonal perspective view of a fully assembled pizza pie container system showing an air vent aperture thereof.

The width of each sidewall 18 generally defines the height of the entire enclosure as may be noted with reference to FIG. 4.

A fourth sidewall 22 is integral both with the rear edge 24 of said square bottom base 20 of the enclosure 10 and with a base 26 of a top cover 25 of the enclosure 10. As may be noted, said fourth sidewall 22 includes at least aperture 28 (see all FIGS. 4 and 5) and may also include a second aperture 30. The purpose of which apertures is to permit venting of steam from both lower pizza pie 30 which is disposed upon bottom base 20 and within lower compartment 32 of the resultant structure and an upper compartment 38. See FIG. 5.

In another embodiment of the invention, a smaller vent aperture 128 may be used to facilitate venting of lower compartment 32 only. See FIG. 5A As may be noted, top cover 25 also includes three sidewalls 34 apart from said fourth sidewall 22. These sidewalls are proportioned in geometry to said three sidewalls 18 which are peripherally integral relative to bottom base 20 such that said sidewalls 34 of top cover 25 may be slipped within bottom base sidewalls 18 in the manner shown in FIG. 5 when the entire system is assembled.

With further reference to said top cover sidewalls 34, there is provided at fl least one aperture 35 therein proximally to fold line 36 between flap 34 and base 26 of top cover 25 such that, after assembly of the system (see FIGS. 5 and 5A), steam from upper compartment 38 emanating from upper pie 40 may vent therethrough.

It is also noted that pie support platform 12 is provided with at least one aperture 42 which is preferably located at fold line 43 between equilateral flap 14 and pie support base 16. In a preferred embodiment, a second such aperture 44 is provided which, upon assembly of the entire system, will be in registration with second aperture 30 of said fourth sidewall 22 of enclosure top 25. See FIG. 1

Figure 2:
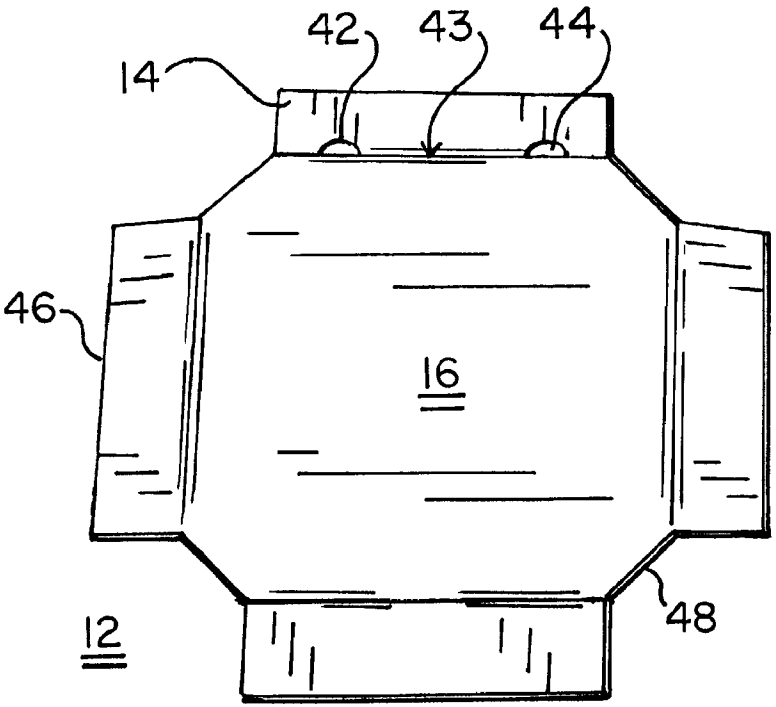
FIG. 2 is a top view of the pie support platform prior to folding of the flaps thereof to a right angle relative to the base of said platform.

As may be noted in the top view of FIG. 2, said pie support platform 12, when in its flattened unfolded form, defines an irregular octahedron having four long edges 46 which alternate with four diagonal edges 48. The benefit of this structure may be appreciated with reference to FIG. 6, which is an illustration of the use of the present system after it has been delivered to a customer. It may, therefrom, be appreciated that after pizza top 25 is opened, diagonal edges 48, in combination with side panels 14 (which acts as legs of the structure) provide a means by which support platform 12 may be readily engaged by the fingers of a user to slide upper pie 40 to the left of lower pie 30 and, therefrom, lift the same away from enclosure 10.

Figure 3:
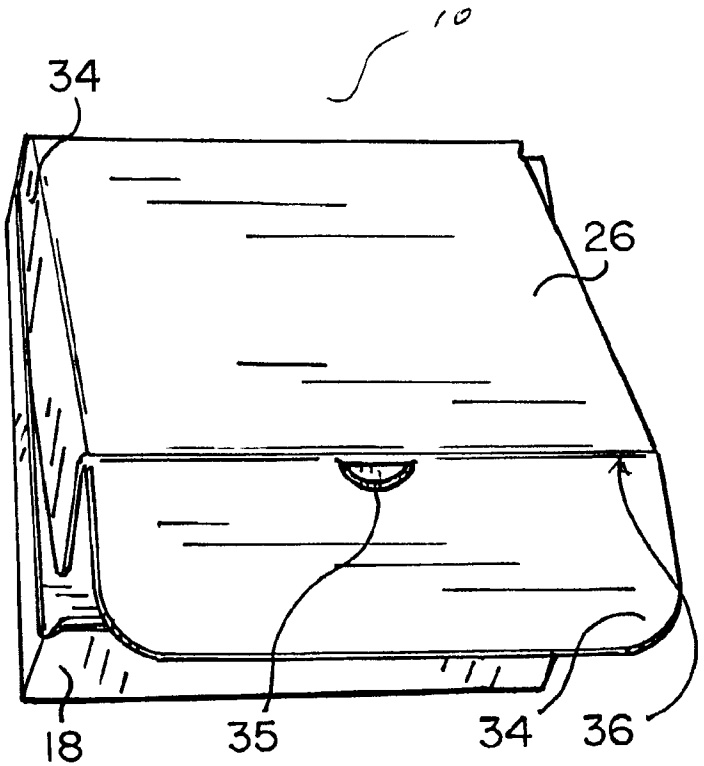
FIG. 3 is a front perspective view of a partially closed box.
Figure 5:
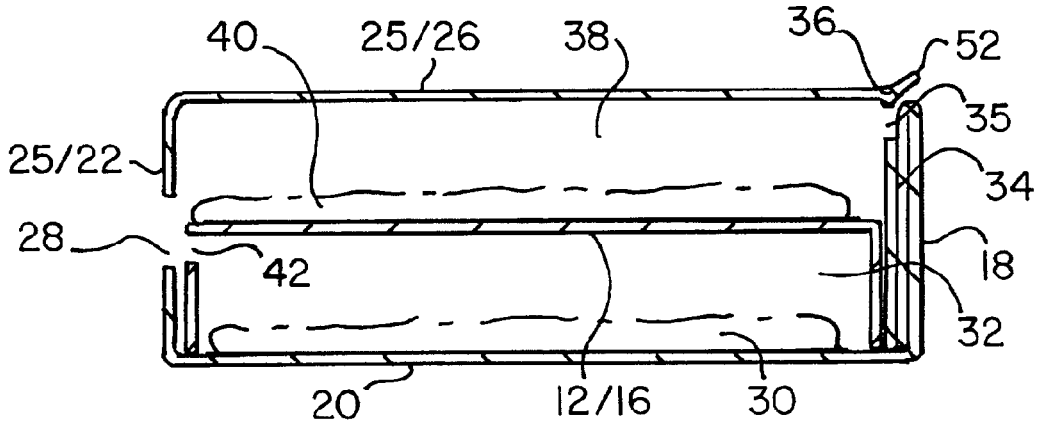
FIG. 5 is a vertical cross-sectional view taken along line 55 of FIG. 4 showing the respective upper and lower pie-containing compartments of the system, and further showing the steam vent apertures for the respective upper and lower compartments
Figure 5A:
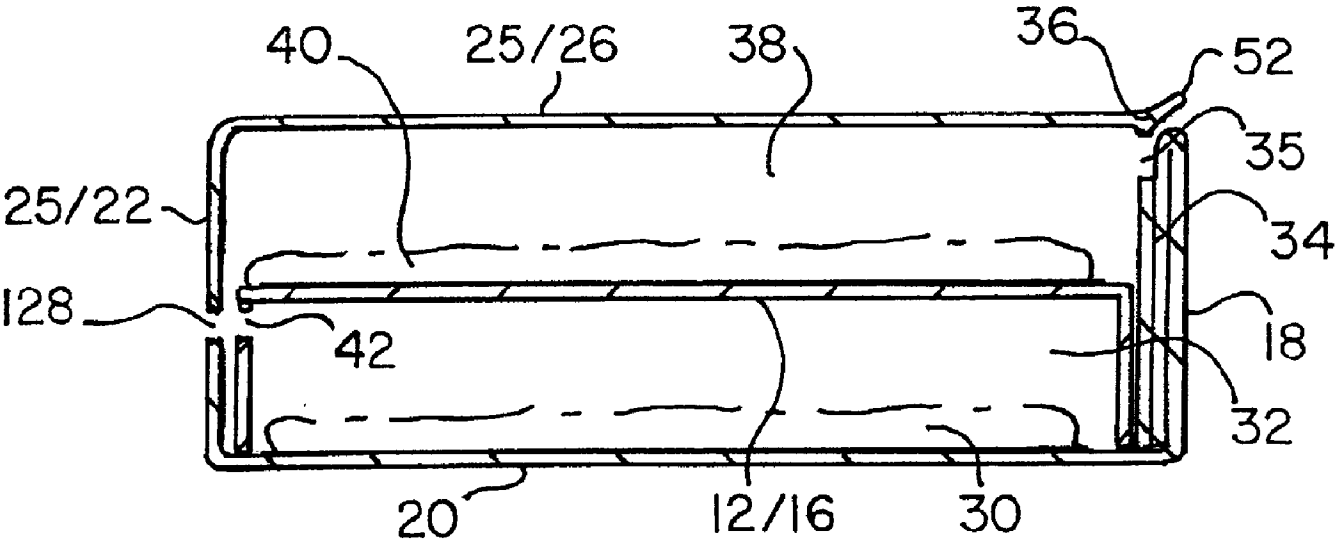
FIG. 5A is a view, similar to that of FIG. 5, showing another embodiment of the vent aperture structure.

In FIGS. 3 and 5 is shown the manner of insertion of sidewalls 34 top cover 25 within sidewalls 18 of the bottom base 20 of the enclosure 10. Due to a slightly greater width, sidewalls 34 of top cover 25 of enclosure 10 versus that of sidewalls 18 of the bottom base 20 of said enclosure, said aperture 35 of sidewall 34 will extend slightly above front sidewall 18 of bottom base 20. See FIG. 5.

Figure 6:
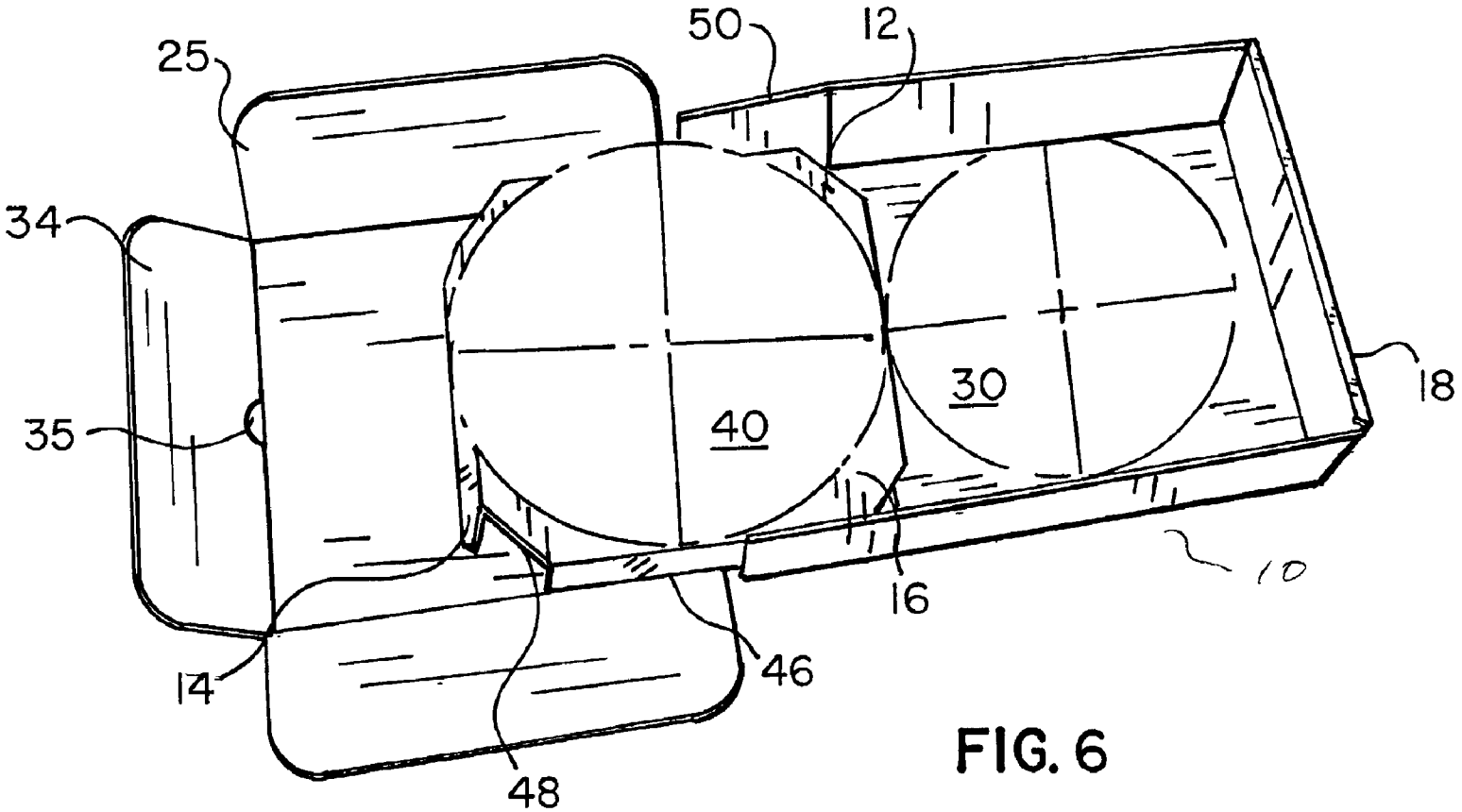
FIG. 6 is a functional view showing removal of the pie support platform and opening of the enclosure of the system after delivery to a customer.

To assure added stability of the system, enclosure 10 may be provided with partial sidewalls 50 (see FIGS. 1 and 6). Also, top base 26 may be provided with a tab 52 disposed just above said aperture 35 of sidewall 34 will extend slightly above front sidewall 18 of bottom sidewall of bottom base 20, this to enhance convenience of opening of enclosure cover 26. See FIGS. 4 and 5.

In order to assure added stability of the system, enclosure 10 may be provided with partial sidewalls 50 (see FIGS. 1 and 6).

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having thus described my invention, what I claim as new, useful, and non-obvious and, accordingly, secure by Letters Patent of the United States is:

1. A dual pizza pie container system, comprising:

(a) an enclosure comprising:

(i) a substantially square bottom base comprising at least three peripheral sidewalls foldably integral with said base, each width of each sidewall generally defining a height of said enclosure; and (ii) a top cover comprising a base and three peripheral sidewalls foldably integral with said base, and a fourth sidewall integral with both an edge of said bottom base and an opposing edge of said top base, said fourth sidewall having at least one aperture therein, and an opposing one of said three top base sidewalls also having an aperture therein; and (b) a pie support platform having four foldable equilateral flaps which, when folded to generally right angles relative a central base thereof, define an irregular octahedron having four long edges defining a virtual square and four alternating diagonal edges, at corners of said virtual square, when said equilateral flaps are folded at substantially right angles to said central base, in which said central base is proportioned for complemental placement upon said bottom base of said enclosure, in which at least one of said equilateral flaps includes at least one aperture therein, in which insertion of said support platform into an assembled enclosure effects registration of said aperture with said at least one aperture of said fourth sidewall of said top base of said enclosure, in which sidewalls of said pie support platform define about half of the height of said enclosure sidewalls when said enclosure is assembled, whereby an upper and lower interior solid horizontal compartments are defined when said support platform is slip fittably positioned within an interior of said enclosure, and when said enclosure has been assembled, further whereby manual gripping of said pie support platform, for purposes of removal of an upper pie, after delivery of the system is facilitated by placement of fingers of a user beneath said alternating diagonal edges of said pie support platform and inwardly of corners of said peripheral sidewalls of said bottom base after said closure has been assembled.

2. The system as recited in claim 1 in which said enclosure further comprises partial sidewalls foldably integral with at least two of said peripheral sidewalls of said bottom base which, after assembly of said enclosure, are substantially co-planar opposing sidewalls which are integral with said bottom base of said enclosure.

3. The container system as recited in claim 1 in which registration of said at least one aperture of said fourth sidewall of said top cover of said enclosure with said at least one aperture of said pie support platform comprises means for fluid venting of heat and moisture emanating from a pie positioned upon said support platform in said upper interior horizontal compartment of the system.

4. The system as recited in claim 1 in which a front sidewall of said three peripheral sidewalls of said top cover of said enclosure include an aperture proximal to a fold line with said top cover base thereof, providing a path for venting of heat and moisture emanating from a pie placed upon the pie support platform.

5. The system as recited in claim 3, in which said at least one aperture of said fourth sidewall of said top cover defines sufficient diameter to provide fluid communication both with said one aperture of said one of said flaps of said platform and with an interior of said upper horizontal compartment.

6. The system as recited in claim 4 in which said base of said top cover includes a tab above said aperture of said top cover.

* * * * *